United States Patent [19]

Regalbuto et al.

[11] Patent Number: 4,739,839

[45] Date of Patent: Apr. 26, 1988

[54] CAPSULE CHARGE PERFORATING SYSTEM

[75] Inventors: John A. Regalbuto; Jerry L. Walker, both of Fort Worth, Tex.

[73] Assignee: Jet Research Center, Inc., Arlington, Tex.

[21] Appl. No.: 944,681

[22] Filed: Dec. 19, 1986

[51] Int. Cl.[4] ..... E21B 43/117

[52] U.S. Cl. ..... 175/4.52; 175/4.6; 166/55

[58] Field of Search ..... 175/4.51, 4.52, 4.56, 175/4.6; 166/55, 213, 241; 102/3.2, 321

[56] References Cited

U.S. PATENT DOCUMENTS

| | | | |
|---|---|---|---|
| 2,543,814 | 3/1951 | Thompson et al. | 102/20 |
| 2,690,123 | 9/1954 | Kanady | 175/4.52 |
| 2,796,023 | 6/1957 | Abendroth | 175/4.52 |
| 2,899,633 | 8/1959 | Smith et al. | 166/241 |
| 2,912,930 | 11/1959 | Caldwell | 102/20 |
| 2,924,173 | 2/1960 | Robertson | 102/20 |
| 2,947,253 | 8/1960 | Cirilo | 102/20 |
| 2,965,031 | 12/1960 | Johns | 175/4.52 |
| 2,990,774 | 7/1961 | Toekle | 102/20 |
| 3,067,678 | 12/1962 | Caldwell et al. | 102/20 |
| 3,067,679 | 12/1962 | Caldwell et al. | 102/20 |
| 3,107,611 | 10/1963 | Caldwell et al. | 102/20 |
| 3,107,612 | 10/1963 | Caldwell et al. | 102/20 |
| 3,116,689 | 1/1964 | Sumner | 102/20 |
| 3,181,608 | 5/1965 | Palmer | 175/4.52 |
| 3,342,130 | 9/1967 | Miller et al. | 175/4.52 |
| 3,555,689 | 1/1971 | Cubberly, Jr. | 166/241 |
| 3,636,875 | 1/1972 | Dodson | 102/20 |
| 3,643,739 | 2/1972 | Hall, Sr. | 166/241 |
| 3,707,195 | 12/1972 | Lanmon, II | 175/4.52 |
| 3,858,651 | 1/1975 | Wolk | 175/4.52 |
| 4,105,073 | 8/1978 | Brieger | 175/4.52 |

*Primary Examiner*—Stephen J. Novosad
*Assistant Examiner*—William P. Neuder
*Attorney, Agent, or Firm*—James Duzan; L. Wayne Beavers; Alan T. McCollom

[57] ABSTRACT

A perforating gun apparatus includes an elongated radially resilient carrier with a plurality of capsule type shaped charges attached to the carrier in a circumferentially phased pattern. The carrier is capable of passing downward through restricted diameter openings and subsequently expanding so as to hold the shaped charges with a near zero standoff from the well bore which is to be perforated.

18 Claims, 4 Drawing Sheets

CAPSULE CHARGE PERFORATING SYSTEM

BACKGROUND OF THE INVENTION

1. Field Of The Invention

The present invention relates generally to perforating systems for perforating a well bore, and more particularly to perforating systems for use with capsule type shaped charges.

2. Description Of The Prior Art

The problem addressed by the present invention is that of passing a perforating gun through a restricted downhole opening, and then properly locating the perforating means of the gun substantially adjacent the well bore after the perforating gun reaches the portion of the well bore which is to be perforated.

Prior art approaches to solving this problem have been very different from the present invention.

One manner in which the prior art has addressed this problem is through the use of a "swing jet" arrangement wherein the charges are pivotally connected to a housing so that the charges may be vertically oriented for passage downward through a restricted opening; then a mechanical arrangement swings the charges through an angle of 90° to rotate the forward ends of the charges outward closer to the well bore to be perforated. Such arrangements are shown in U.S. Pat. Nos. 2,912,930, 2,543,814, 2,924,173, 2,947,253, 2,990,774, 3,067,678, 3,067,679, 3,107,611, 3,107,612 and 3,116,689.

While the swing jet arrangement does provide a solution to the problem described above, it does so through a rather complex mechanical actuating mechanism.

A second approach found in the prior art is the use of an eccentric kickover spring arrangement so that the perforating gun is pushed off center to one side of the well bore to form a single vertical row of perforations along only one side of the well bore. One such arrangement is shown in U.S. Pat. No. 3,707,195. Another such arrangement has been marketed by the Dresser Atlas Division of Dresser Industries, Inc., under the same Silver Jet SM.

Although these eccentric kickover springs are to some extent less mechanically complicated than the swing jet arrangement, they suffer from the very severe limitation of only providing a single row of perforations along one side of the well bore. It is much preferable to have circumferentially spaced perforations all the way around the well bore.

SUMMARY OF THE INVENTION

The present invention provides a perforating system for use with capsule type shaped charges which allows the perforating gun to be run downhole through restricted openings and to subsequently expand to closely fit within the well bore portion to be perforated and to provide a near zero standoff between the shaped charges and the well bore.

The perforating gun apparatus of the present invention includes an elongated radially resilient carrier having a plurality of perforating means attached to the carrier in a circumferentially phased pattern. The carrier and attached perforating means have a radially unconstricted larger transverse dimension preferably slightly greater than the inner diameter of the well bore to be perforated. The carrier and attached perforating means can be radially contracted to a radially constricted smaller transverse dimension small enough to fit through the restricted openings which are encountered as the perforating gun passes downhole to that portion of the well bore which is to be perforated.

In the preferred embodiment the apparatus includes upper and lower end subs with at least two separable elongated flexible carrier strips individually connected to the upper and lower subs. The carrier strips are made flexible so as to act like a centralizer. The shaped charges are attached to the carrier strips.

As the apparatus passes downhole through a restricted opening, the carrier strips and the attached shaped charges flex radially inward so that the perforating gun may pass through the restricted opening. After passing through the restricted opening, the carrier strips flex back outward to hold the shaped charges against the well bore which is to be perforated. The flexibility of the carrier strips may be provided or supplemented by expander springs connected between the strips.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 1, the perforating gun has been lowered into the well bore and is at a position above the restricted opening. In FIG. 2, the perforating gun is passing through the restricted opening and has been radially contracted. In FIG. 3, the perforating gun apparatus has passed through the restricted opening and is in position in that portion of the well bore which is to be perforated, with the perforating gun apparatus expanded to hold the charges substantially against the well bore.

FIG. 10 is rotated counterclockwise 30° from the orientation along which the plan of line 10—10 would normally be shown.

DETAILED DESCRIPTION OF THE PREFERRED EMBODIMENTS

Figure 1:
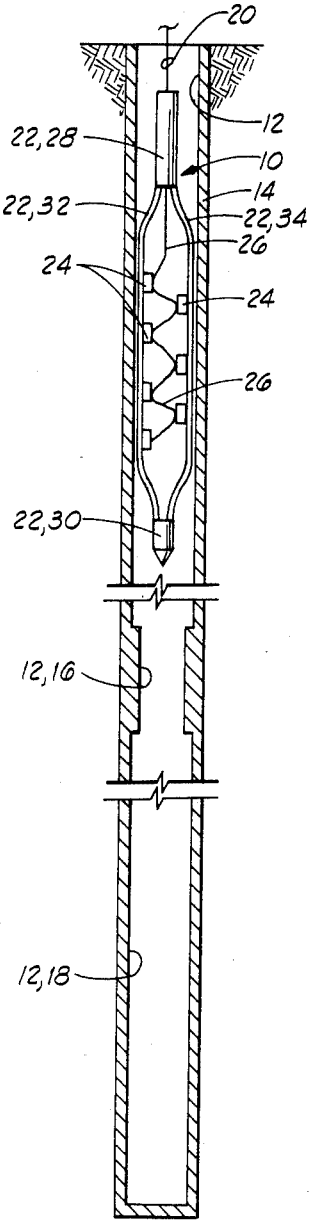
FIGS. 1–3 illustrate three sequential positions of the perforating gun apparatus of the present invention as it passes downhole through a restricted opening to the final location in the well bore at which the perforations are to be made.
Figure 2:
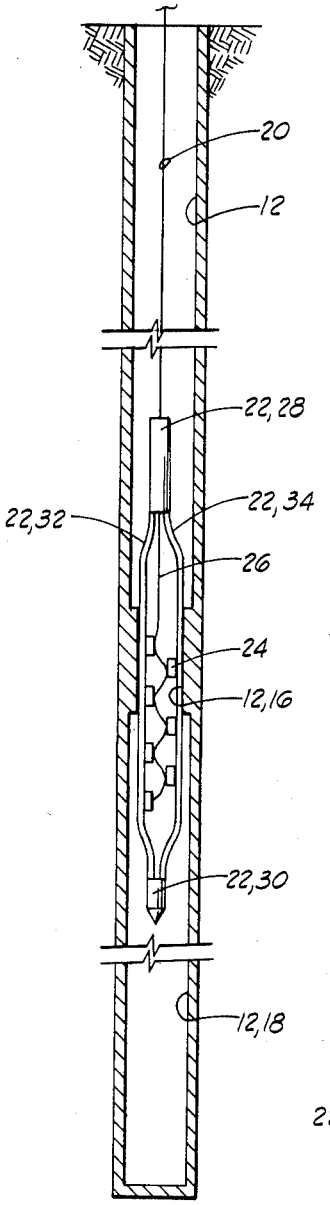
Figure 3:
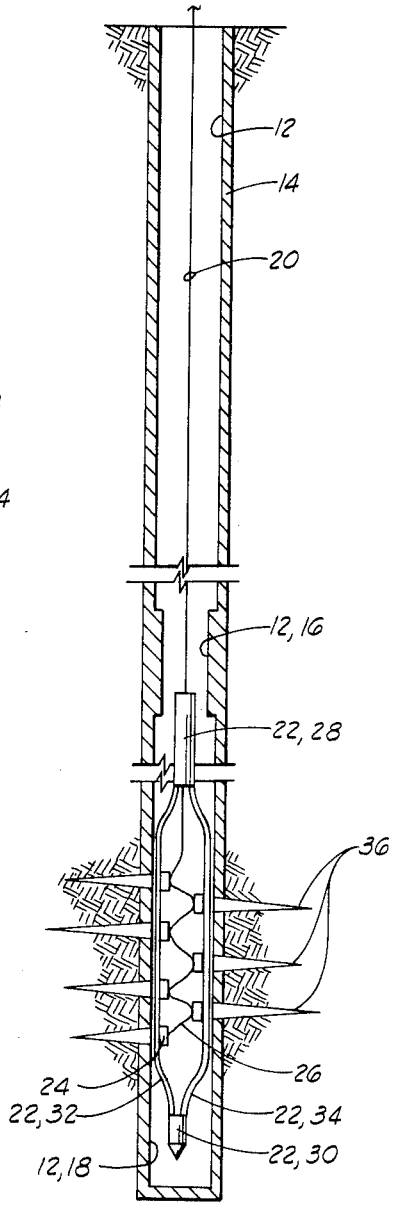

Referring now to the drawings, and particularly to FIGS. 1–3, a perforating gun generally designated by the numeral 10 is shown in place in an upper portion of a well bore 12 defined by a schematically illustrated well casing 14. A restricted opening 16 is defined in the well bore 12 above a lower portion 18 of the well bore 12 which is to be perforated.

The perforating gun 10 is lowered into the well bore 12 on a wire line 20.

The perforating gun 10 includes an elongated radially resilient carrier means 22 which is schematically illustrated in FIGS. 1–3. A plurality of perforating means 24 which preferably are capsule type shaped charges are attached to the carrier means 22 in a circumferentially phased pattern as is apparent in viewing FIG. 10 discussed below. Capsule type shaped charges 24 are those which are each contained in individual pressure vessels so that the entire capsule can be subjected to the downhole environment.

The carrier means 22 includes an upper end sub 28 and a lower end sub 30 with a plurality of separable elongated flexible carrier strips such as 32 and 34 individually connected to the upper and lower end subs 28 and 30.

A detonating cord 26 is connected to each of the perforating means 24. The detonating cord 26 is connected to a firing means (not shown) located in the upper end sub 28.

As is further explained below, the carrier means 22 and attached perforating means 24 have a radially unconstricted larger transverse dimension or outside diameter 97 (see FIG. 10) which is preferably slightly larger than the inside diameter of the lower portion 18 of well bore 12 which is to be perforated. The purpose of this is to hold the capsule type shaped charge perforating means 24 adjacent the wall of the lower well bore portion 18 so as to provide a zero or near zero standoff distance between the shaped charges 24 and the well bore 18. As will be understood by those skilled in the art, shaped charge type perforating means are designed to be most effective when located immediately adjacent the surface which is to be perforated.

In many wells, restricted diameter areas are encountered due to deviations of the well bore, other apparatus located in the well bore, or other known types of situations.

The perforating gun apparatus 10 of the present invention can pass downward through these restricted openings such as 16 by collapsing radially inward as schematically illustrated in FIG. 2.

After the perforating gun apparatus 10 has passed downward through the restricted opening 16 as schematically illustrated in FIG. 3, the carrier strips like 32 and 34 flex radially outward to hold the perforating means 24 against the lower well bore portion 18 which is to be perforated.

Upon firing of the shaped charge perforating means 24, a plurality of perforations such as 36 are formed through the well casing 14 and extending into the subsurface formation.

In a preferred embodiment, each of the carrier strips is a wire type carrier strip.

Figure 4:
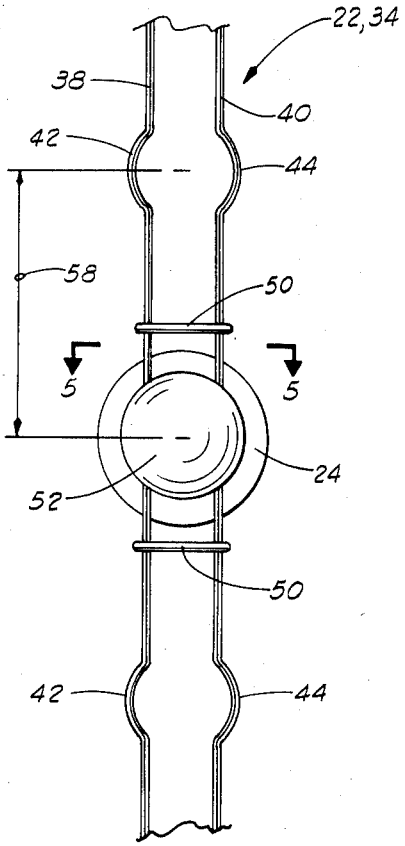
FIG. 4 is an enlarged elevation view of a segment of one wire type carrier strip showing one shaped charge in place therein.

In FIG. 4, an elongated segment of one such wire type carrier strip 34 is illustrated. The wire type carrier strip 34 is comprised of a pair of substantially parallel wire members 38 and 40 having deformed portions such as 42 and 44, respectively, for receiving the shaped charge perforating means 24 therebetween.

In FIG. 4, the segment of carrier strip 34 illustrated includes three such deformed portions 42,44, with a shaped charge perforating means 24 being illustrated in place within the middle such deformed portion 42,44.

The deformed portions 42 and 44 of wire members 38 and 40 are held in place about a necked down part 46 of shaped charge 24 (see FIG. 5) by tie means such as 50.

Figure 5:
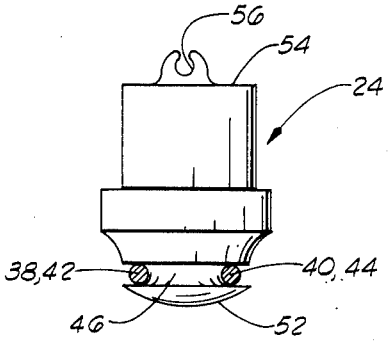
FIG. 5 is a plan view taken along line 5—5 of FIG. 4 showing the profile of one shaped charge as held within the wire type carrier strip.

The shaped charge 24 shown in FIGS. 4 and 5 has a forward face 52 which is intended to be held against the well bore 18 to be perforated. The shaped charge 24 further has a rear end 54 which has an opening 56 defined therein for receiving the detonating cord 26.

With the radially resilient carrier design of the present invention, the forward faces 52 of the shaped charges 24 will normally be held against the well bore as the perforating apparatus 10 is lowered into the well. This sliding engagement of forward face 52 with the well bore will cause some abrasive wear of the forward face 52. This must be taken into account when designing the forward face 52 to make it thick enough so as to accommodate this abrasive wear and still maintain the pressure integrity of the shaped charge 24. The forward face 52 must not be made too thick, however, because if the forward face 52 is too thick, it will decrease the efficiency of the shaped charge so that it does not penetrate as deep into the surrounding formation. Alternatively, other wearing elements could be added to the carrier so that the forward face 52 of the shaped charge did not actually engage the well bore but was held slightly spaced from the well bore.

The carrier strip 34 can be of any desired length, typically on the order of many feet, and will have a longitudinal spacing 58 between adjacent charges on the order of three inches.

Figure 8:
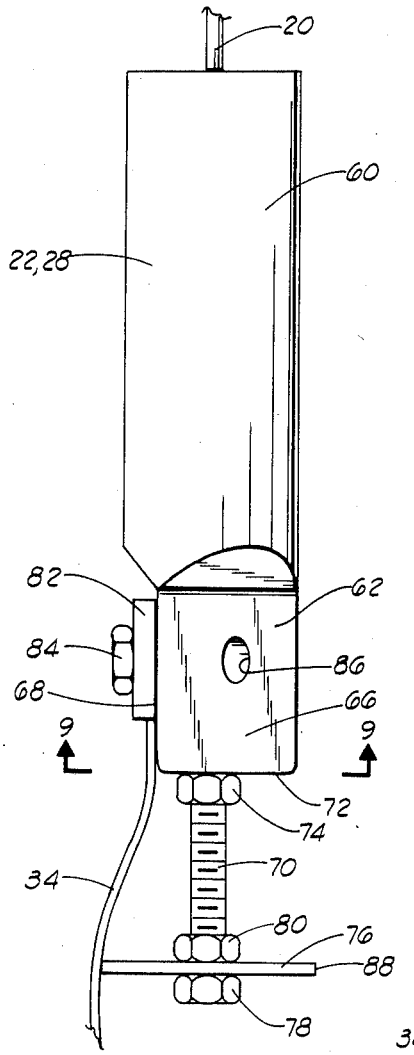
FIG. 8 is an elevation somewhat schematic view showing the upper end sub with one wire type strip attached thereto, and showing an adjustable means for flexing the carrier strips radially outward.

FIG. 8 is an enlarged, somewhat schematic elevation view of an upper end sub 28 designed for use with three wire type carrier strips like the carrier strip 34 of FIG. 4.

Figure 9:
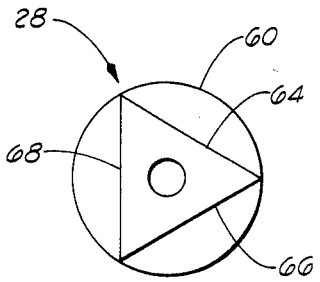
FIG. 9 is a view along line 9—9 of FIG. 8 showing the lower end of the upper end sub.

The upper end sub 28 has a cylindrical upper portion 60 and a triangular cross section lower portion 62 having three elongated flat surfaces 64, 66, and 68 defined thereon as best seen in FIG. 9.

FIG. 8 also illustrates one means by which the carrier strips such as 34 can be held in an outwardly flexed position so as to act as a centralizer for the apparatus 10. In FIG. 8, a stud 70 is threaded into a lower end 72 of upper end sub 28. A locking nut 74 holds the stud 70 in position relative to upper end sub 28.

A large diameter washer 76 is held in place on the lower end of stud 70 between a stud head 78 and another nut 80.

The wire type carrier strip 34 has its upper end attached to the flat side 68 of upper end sub 28 by a wire clamp 82 which is held in place by a bolt 84 which extends into a threaded opening like 86 in the flat 68.

The wire type carrier strip 34 is held in a radially outward flexed position by the outer periphery 88 of large diameter washer 76. Other wire type carrier strips (not shown) are similarly attached to flat sides 64 and 66.

A similar large diameter washer arrangement is provided on the lower end sub 30 so that the wire type carrier strips 34 are caused to bow outwardly in a manner like that schematically illustrated in FIGS. 1–3.

Figure 6:
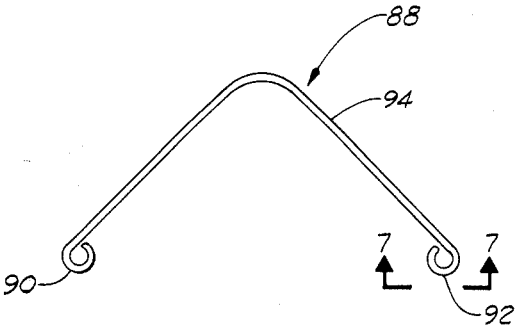
FIG. 6 is a plan view of an expander spring.
Figure 7:
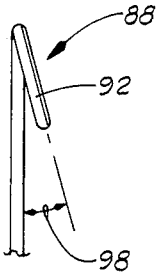
FIG. 7 is a view taken along line 7—7 of FIG. 6 showing the construction of the end portion of the expander spring.

Another means by which the individual carrier strips such as 34 may be held in a radially outward flexed position is through the use of expander springs 88, the details of which are shown in FIGS. 6 and 7.

Each expander spring 88 is a U-shaped wire spring having first and second ends 90 and 92 for connection to one of the wire members such as 38 or 40 of two adjacent carrier strips. The expander spring 88 has a flexible middle portion 94.

Figure 10:
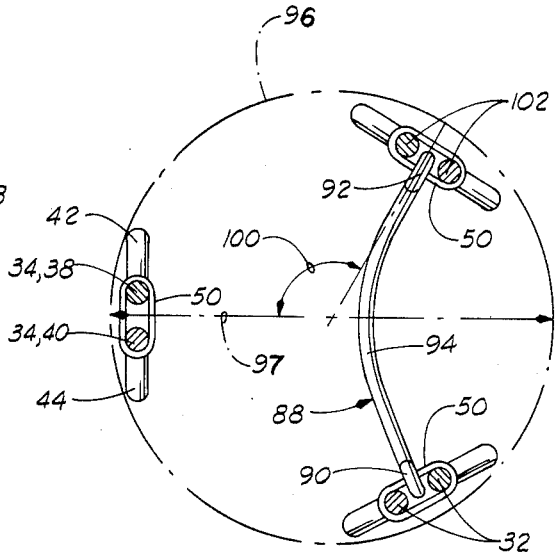
FIG. 10 is a somewhat schematic horizontal section view taken along line 10—10 through the perforating gun of FIG. 11 showing the relative orientation of three wire type carrier strips with one expander spring like that of FIG. 6 in place.

FIG. 10 is a somewhat schematic illustration showing in cross section three wire type carrier strips 32, 34, and 102. Each of the wire type carrier strips is constructed like the carrier strip 34 illustrated in FIG. 4.

In FIG. 10, one expander spring 88 is shown in place between wire type strips 32 and 102.

Figure 11:
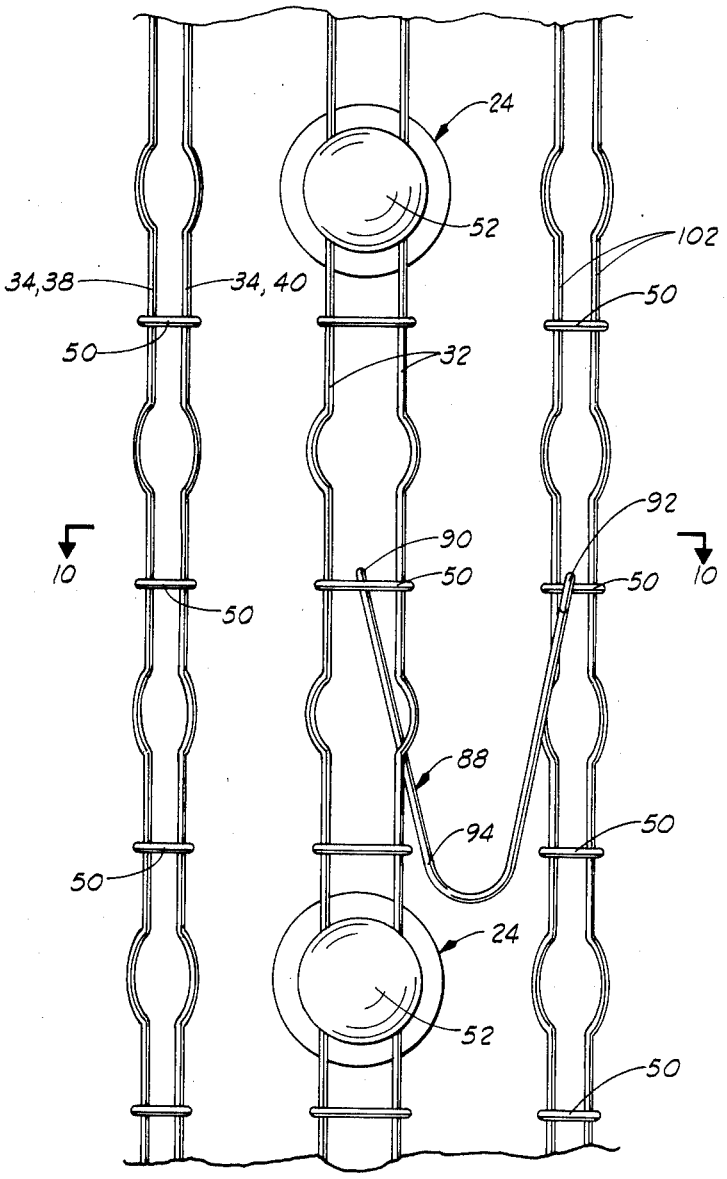
FIG. 11 is a somewhat schematic elevation view of the perforating gun of FIG. 10 taken along line 11—11 of FIG. 10.

As can best be appreciated in viewing FIGS. 10 and 11 together, the expander spring 88 is connected to the wire type strips 32 and 90 by placing the tie means 50 through the eyelets at ends 90 and 92 of the expander spring means 88. Each of the tie means 50 connected to expander spring 88 is threaded through the eyelets at end 90 or 92 before that tie means 50 is attached to its respective wire strip 32 or 102.

As can best be seen in FIG. 11, the expander spring 88 will hang generally in a vertical plane although it may tilt slightly radially inwardly as shown in FIG. 10.

The apparatus is shown in its radially unconstricted position in FIG. 10. An imaginary circumference of the apparatus 10 is shown in phantom lines in FIG. 10 and designated by the numeral 96. The maximum unconstricted transverse dimension of the apparatus 10 as shown in FIG. 10 is the diameter 97 of circumference 96.

As best seen in FIG. 7, the ends 90 and 92 of expander spring 88 are bent in a circular shape somewhat out of the plane of middle portion 94 by an angle 98 which preferably is on the order of 15° to 30°. This allows the loop of the ends 90 and 92 to lie in planes extending substantially radially from a central axis of the apparatus 10 as is best seen in FIG. 10.

In FIG. 11, only one expander spring 88 has been shown, and the perforating means 24 located in wire type carrier strips 34 and 102 have not been illustrated. Two perforating means 24 have been shown in wire type carrier strip 32.

The vertical spacing between expander springs 88 will be approximately two feet. The actual spacing will, of course, be determined by the physical dimensions of the carrier strips and the expander springs. Sufficient expander springs should be used to provide the necessary overall resilience of the carrier strips.

The expander spring 88 shown in FIG. 11 is connected between carrier strips 32 and 102. The next expander spring 88 (not shown) located above the one shown in FIG. 11 would be connected between carrier strips 34 and 32, and the next expander spring 88 (not shown) below the one shown in FIG. 11 would be connected between carrier strips 34 and 102.

Thus, along the length of the perforating apparatus 10, there will be a number of expander springs 88 connected between each two adjacent carrier strips to provide an overall carrier assembly having the desired radial resilience.

The large diameter washer arrangement of FIG. 8 and the expander springer arrangement of FIG. 10 may be used together, or either may be used alone in appropriate circumstances.

The large diameter washer arrangement illustrated in FIG. 8 can in some instances be used without the expander springs 88. If the carrier strips are sufficiently stiff, and are of a relatively short length, the use of the large diameter washer arrangement alone may be sufficient to provide the centralizing effect desired.

When, however, the carrier strips are relatively long and/or relatively flexible, the use of a large diameter washer arrangement alone will not be sufficient to provide the radial resilience desired along the middle portions of the carrier strips. In those situations, it will be desirable to have the expander springs 88 placed periodically along the length of the carrier strips.

Also, the large diameter washer arrangement can be eliminated if sufficient expander springs are utilized.

The carrier means 22 which includes the three wire type carrier strips 32, 34 and 102 is a centralizing carrier means 22, the longitudinal central axis of which remains substantially centered within the well bore 12.

As is apparent in FIG. 10, the use of three carrier strips 32, 34 and 102 attached to the upper and lower end subs 28 and 30 in a circumferentially equally spaced arrangement provides a circumferentially phased pattern between charges having a circumferential phasing 100 of 120°.

It will be appreciated that the appartus 10 could be constructed with more than three separate carrier strips. For example, the use of four circumferentially equally spaced carrier strips would provide a circumferential phasing of 90° between charges. The use of five equally spaced carrier strips would provide a circumferential phasing of 72°. The use of six equally spaced carrier strips would provide a circumferential phasing of 60°. Also, the use of two carrier strips as shown in FIGS. 1–3 provides a circumferential phasing of 180°.

It is within the scope of the present invention to provide any of these arrangements, and generally the circumferential phasing is preferably in a range from about 60° to about 180°.

The carrier strips do not have to be wire type carrier strips. It is within the scope of the present invention to use any elongated flexible member capable of carrying the charges being used. For example, the carrier strip could be a thin walled metal strip having openings within which the charges are received.

With the apparatus of the present invention additional advantages are provided other than the radially resilient feature which allows the apparatus to pass through restricted openings.

Another advantage is that increased shot densities are allowed as compared to most prior art devices. With the arrangement illustrated in FIGS. 8–11 having three carrier strips, and with a three-inch spacing between charges on each strip, a shot density of twelve shots per foot can be accomplished. Through the use of the multiple carrier strips, increased shot densities and more uniform distribution of the perforations around the circumference of the well bore are provided.

Thus it is seen that the apparatus of the present invention readily achieves the ends and advantages mentioned as well as those inherent therein. While certain preferred arrangements of the apparatus have been illustrated for the purposes of the present disclosure, numerous changes in the arrangement and construction of parts may be made by those skilled in the art which changes are encompassed within the scope and spirit of the present invention as defined by the appended claims.

What is claimed is:

1. A perforating gun apparatus for perforating a subsurface earth formation penetrated by a well bore, said appartus comprising:
an elongated radially resilient carrier including:
an upper end sub;
a lower end sub;
at least two laterally spaced, elongated flexible carrier strips extending longitudinally between and connected to said upper and lower end subs;
a plurality of perforating means mounted on said resilient, elongated flexible carrier strips; and
means for laterally biasing said carrier strips radially outwardly when said apparatus is received in the well bore thereby urging said perforating means toward the wall of the well bore.

2. The apparatus of claim 1, wherein:
said carrier strips are disposed in a substantially equally circumferentially phased pattern and said biasing means is adapted to laterally radially outwardly bias said carrier strips.

3. The apparatus of claim 2, wherein:
said carrier is further characterized as a centralizing carrier having a longitudinal central axis which remains substantially centered in a well bore in which said perforating gun apparatus is received.

4. The apparatus of claim 2, wherein:
said radially resilient carrier is further characterized as a means for allowing said perforating gun apparatus to substantially radially contract for passage through downhole restrictions and to subsequently radially expand said perforating gun apparatus against a bore hole wall having a substantially greater diameter than said restriction.

5. The apparatus of claim 2, wherein:
said circumferentially phased pattern in which said perforating means are attached to said carrier is further characterized as having a circumferential phasing in the range of from about 60° to about 180°.

6. The apparatus of claim 5, wherein:
said perforating means are capsule type shaped charge perforating means.

7. The apparatus of claim 6, wherein:
said carrier is further characterized as a centralizing carrier having a longitudinal central axis which remains substantially centered in said well bore in which said perforating gun apparatus is received.

8. The apparatus of claim 1, wherein said biasing means comprises:
a plurality of longitudinally spaced expander spring means, extending between and connected to adjacent carrier strips, for resiliently biasing said carrier strips toward a radially expanded position.

9. The apparatus of claim 8, wherein:
each of said expander spring means is a U-shaped wire spring having a first end attached to a first one of said carrier strips and a second end attached to a second one of said carrier strips, and having a flexible middle portion between said first and second ends.

10. The apparatus of claim 1, wherein:
each of said carrier strips is a wire type carrier strip comprised of a pair of substantially parallel wire members having deformed portions for receiving said perforating means therebetween.

11. The apparatus of claim 1, wherein:
said biasing means comprises portions of said elongated carrier strips which are resiliently bowed radially outward adjacent said upper and lower end subs.

12. The apparatus of claim 1, wherein:
said perforating means are capsule type shaped charge perforating means.

13. A perforating gun apparatus for perforating a subsurface earth formation penetrated by a well bore, said apparatus comprising:
an upper end fitting;
a lower end fitting;
at least two substantially equally circumferentially spaced elongated carrier strips extending longitudinally between and individually connected to said upper and lower end fittings;
a plurality of capsule type shaped charges mounted on each of said carrier strips with a circumferential charge phasing in a range of from about 60° to about 180°; and
means for biasing said strips radially outwardly when said apparatus is received in the well bore thereby urging said charges toward the wall of the well bore.

14. The apparatus of claim 13, wherein:
each of said carrier strips is a wire type carrier strip comprised of a pair of substantially parallel wire members having deformed portions for receiving said capsule type shaped charges therebetween.

15. The apparatus of claim 13, wherein:
said elongated carrier strips are resiliently bowed radially outward substantially continuously between said upper and lower end fittings and lower end fittings so that said apparatus has a maximum unconstricted diameter at least as great as an inside diameter of a well bore which is to be perforated while being capable of passing through well bore restrictions substantially smaller than said maximum diameter.

16. The apparatus of claim 15, wherein:
said carrier is further characterized as a centralizing carrier having a longitudinal central axis which remains substantially centered in said well bore.

17. The apparatus of claim 13, further comprising:
a plurality of longitudinally spaced expander spring means extending between and connected to carrier strips, for resiliently biasing said carrier strips toward an unconstricted radially expanded position.

18. The apparatus of claim 17, wherein:
each of said expander spring means is a U-shaped wire spring having a first end attached to a first one of said carrier strips and a second end attached to a second one of said carrier strips, and having a flexible middle portion between said first and second ends.

* * * * *